US005534842A

United States Patent [19]

Nagayama et al.

[11] Patent Number: 5,534,842

[45] Date of Patent: Jul. 9, 1996

[54] CIRCUIT BREAKING SWITCH WITH FUSIBLE ELEMENT THAT RESPONDS TO CURRENT OVERLOADS

[75] Inventors: Keiichi Nagayama, Nagoya, Japan; Masami Noguchi, Aichi-gun; Takahiro Sakakino, Nagoya, all of Japan

[73] Assignee: Omron Corporation, Kyoto, Japan

[21] Appl. No.: 296,800

[22] Filed: Aug. 26, 1994

[30] Foreign Application Priority Data

Aug. 26, 1993 [JP] Japan ..... 5-234161

[51] Int. Cl.[6] ..... H01H 37/76; H01H 85/00

[52] U.S. Cl. ..... 337/402; 337/408; 200/61.08

[58] Field of Search ..... 337/2, 401, 404, 337/405, 402, 408, 403; 335/23, 142

[56] References Cited

U.S. PATENT DOCUMENTS

| | | | |
|---|---|---|---|
| 2,790,049 | 4/1957 | McAlister . | |
| 3,436,712 | 4/1969 | Heaney | 337/405 |
| 4,297,669 | 10/1981 | Gale | 337/407 |
| 4,415,796 | 11/1983 | Balchunas | 337/405 |
| 4,433,231 | 2/1984 | Balchunas | 337/405 |
| 4,472,705 | 9/1984 | Carlson | 337/299 |
| 4,630,023 | 12/1986 | Gawron | 337/407 |
| 4,821,010 | 4/1989 | Plasko | 337/405 |
| 4,906,962 | 3/1990 | Duimstra | 337/239 |
| 5,138,297 | 8/1992 | Hollweck | 337/354 |
| 5,280,262 | 1/1994 | Fischer | 337/405 |

FOREIGN PATENT DOCUMENTS

| | | |
|---|---|---|
| 0285044 | 10/1988 | European Pat. Off. . |
| 8716968 | 6/1989 | Germany . |
| 2167238 | 5/1986 | United Kingdom . |

OTHER PUBLICATIONS

Sakakino Takahiro et al., "SWITCH GEAR", Patent Abstracts of Japan, vol: 015170, Apr. 3, 1991, (Publication Number JP3037921, dated Feb. 19, 1991).

Kuzukawa KIYOAKI, "ELECTROMAGNETIC RELAY", Patent Abstracts of Japan, vol: 15, May 13, 1991, (Publication Number JP3046728, dated Feb. 28, 1991).

*Primary Examiner*—Leo P. Picard
*Assistant Examiner*—Stephen T. Ryan
*Attorney, Agent, or Firm*—Foley & Lardner

[57] ABSTRACT

This invention provides a switch adapted to close upon pressing by an actuator of a movable piece initially in an open switch position, the actuator being made of a material which melts at a predetermined temperature. The switch opens when melting of the actuator by the heat generated from an overcurrent allows the movable piece to return to its initial position. The movable piece is made of a material which fuses at a predetermined temperature, such that the switch opens upon fusion of the movable piece by the heat generated from the flow of an overcurrent through the movable piece.

10 Claims, 6 Drawing Sheets

CIRCUIT BREAKING SWITCH WITH FUSIBLE ELEMENT THAT RESPONDS TO CURRENT OVERLOADS

BACKGROUND OF THE INVENTION

This invention relates to a novel electrical switch suitable for use as a window regulator switch, sunroof switch, or the like. It provides protection for these and other devices against a current overload (overcurrent) from excess currents, current surges, short circuits and the like.

For the protection of direct-off type switches from overcurrents, it is a common practice to employ a PCB pattern fuse or a built-in overcurrent protective device. For the protection of bus bar type switches, it is known to use a movable electrical contact, in which the melting of a resin member supporting or restraining the electrical contact causes an OFF fault. For the overcurrent protection of microswitches, the prior art has available only a PCB pattern fuse or a built-in overcurrent protective device.

PCB pattern fuses, however, are not completely reliable. Pattern width control during manufacture is so difficult to achieve that large variations in functional quality and reliability are inevitable. On the other hand, overcurrent protective devices are expensive and add to the bulk of switches.

SUMMARY OF THE INVENTION

One object of this invention, therefore, is to provide a novel switch system which is simple to construct, and yet provides effective overcurrent protection without major costs or additional parts.

Another object of the invention is to provide an electrical switch with an easily replaceable fusible overcurrent protecting element.

Still another object of the present invention is to provide a heat sensitive electrical switch having ON and OFF positions set by a fusible element, which switch does not require any modification of its components in different applications, and which insures a positive response to a current overload.

The present invention is directed to a switch having a movable electrical contact piece which is initially biased to a switch OPEN position. In normal operation, however, the switch is closed, due to the pressing by a fusible actuator of the initially open movable piece into the switch CLOSE position.

The switch opens and the contact piece returns to its switch OPEN position when the melting of the fusible actuator, from heat generated by an overcurrent in the switch, releases the movable piece. In some instances, the movable piece itself may, as a safety measure, melt before the fusible actuator actually melts, also allowing the contact piece to return to its OPEN position.

This invention relates, in another aspect, to a switch in which a movable piece opens or closes according to the movement of an actuator.

The invention is also characterized in that the switch opens upon fusion of the movable piece by the heat generated from an overcurrent.

This invention relates, in a further aspect, to a switch adapted to close upon the pressing by an actuator of a movable piece, biased toward and, initially in the open position.

The switch is still further characterized in being provided with a spring means which opens the switch when melting of the actuator allows the movable piece to return to its initial position.

In order to achieve the aforementioned objects, there is provided an electrical switch apparatus comprising:

a movable piece biased to render the switch open; and a meltable actuator holding the movable piece in a position that renders the switch closed, the actuator being made of a material that melts from an overcurrent therethrough;

wherein melting of the actuator by such an overcurrent releases the movable piece to open the switch.

BRIEF DESCRIPTION OF THE DRAWINGS

The accompanying drawings, which are incorporated in and constitute a part of the specification, illustrate presently preferred embodiments of the invention. Together with the general description given above and the detailed description of the preferred embodiments given below, the drawings serve to explain the principles of the invention.

DETAILED DESCRIPTION OF THE PREFERRED EMBODIMENTS

The embodiments of the present invention are explained below with reference to the accompanying drawings.

Figure 1:
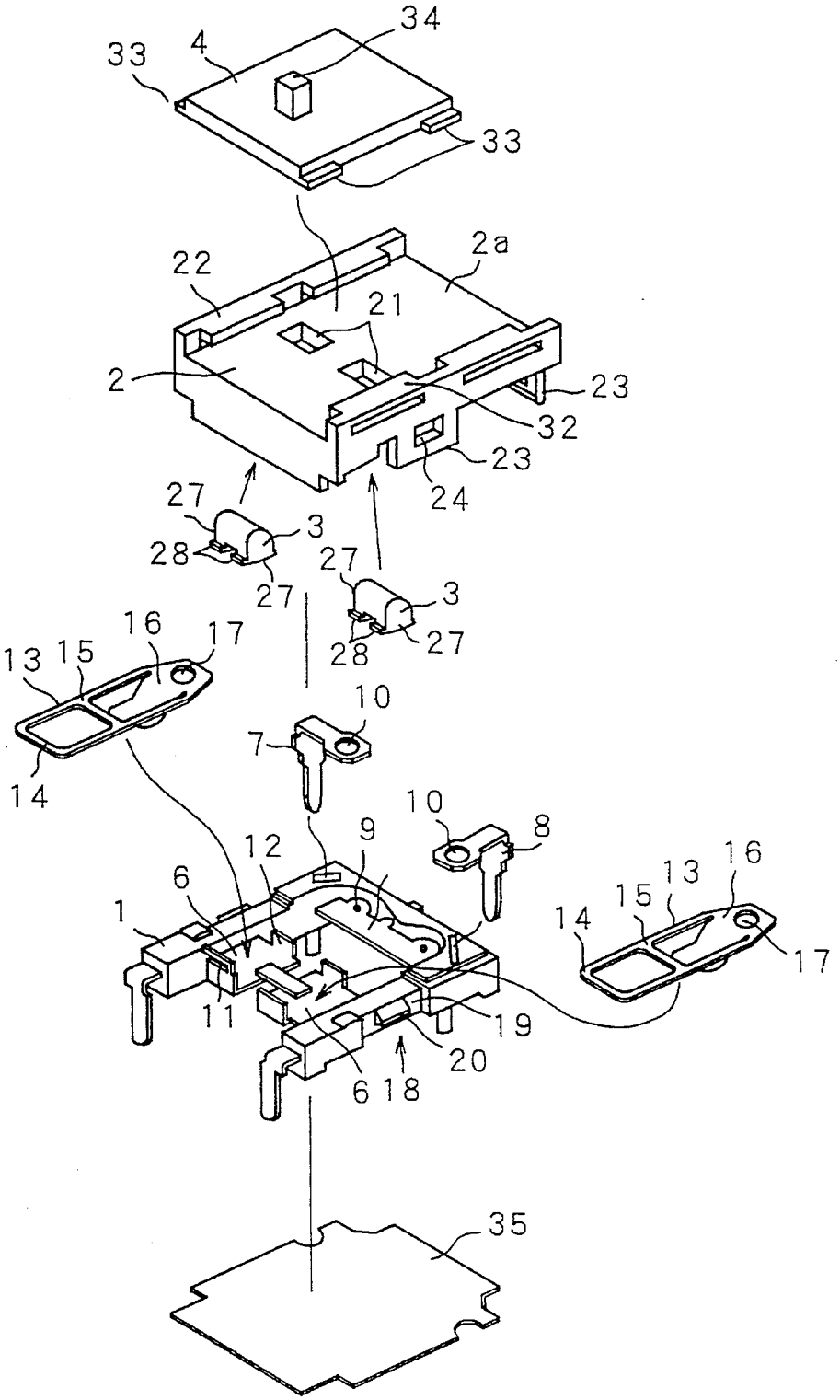
FIG. 1 is an exploded perspective view of the switch according to this invention.

Referring to FIG. 1, the switch according to this invention includes a base 1, a cover 2, an actuator 3 and a slider 4. The switch apparatus is closed at its bottom by plate 35.

The base 1 can be configured to include a switching mechanism at each of its sides (See FIG. 1, noting common terminal 6), thereby permitting two switches of the present invention to be used individually or simultaneously. Nevertheless, the specification proceeds with reference to the operation of a single switch, as shown, for example, in FIG. 4. The second switch operates in exactly the same way as the first, and the simultaneous operation of two switches needs no further explanation.

Figure 4:
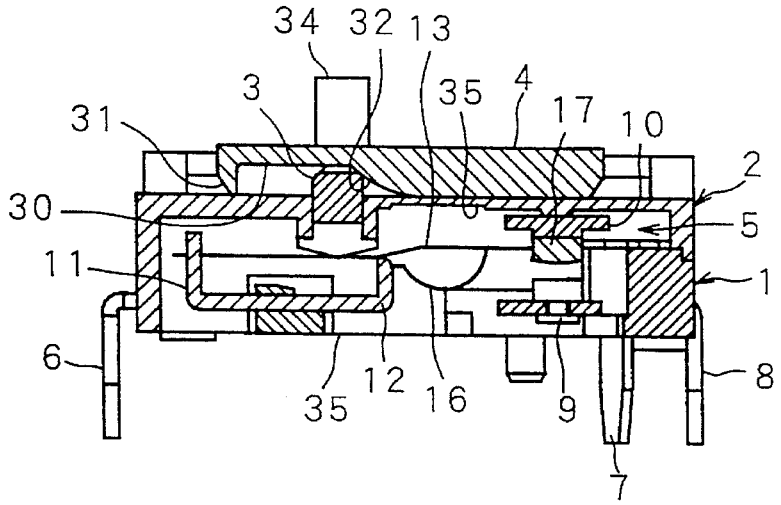
FIG. 4 is a sectional view of the switch taken along the line A—A of FIG. 2.

Referring to FIGS. 1 and 4, current flows through the switch (when closed) from common terminal 6 to terminal 7, through movable piece 13 carrying at its end movable contact 17. These terminals are built in the base 1.

Figure 7:
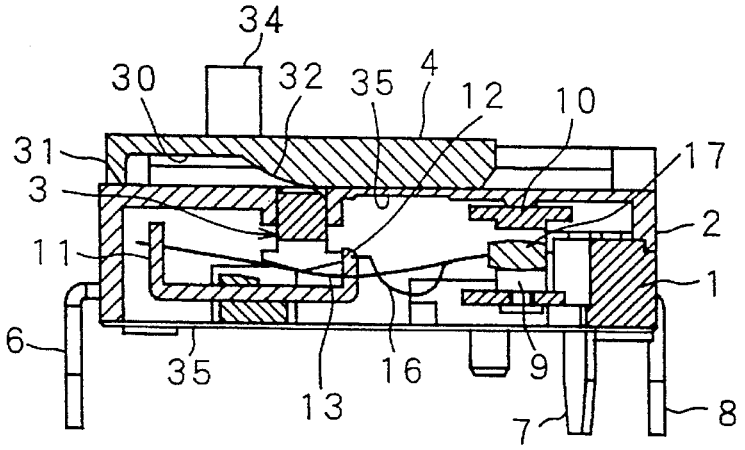
FIG. 7 is a cross-sectional view showing the closed state of the switch according to this invention.

Stationary contacts 9 and 10 are rigidly fixed in the switch apparatus, one above the other in a mutually opposed relation. When the movable contact 17 presses against lower stationary contact 9, the switch is closed. This closed state is illustrated in FIG. 7. When the movable contact 17 presses against the upper contact 10, the switch is open (see FIG. 8).

Figure 5A:
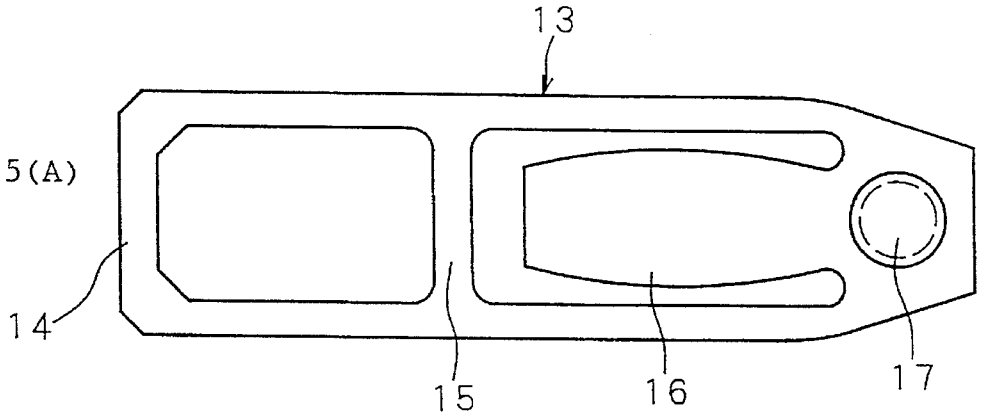
FIG. 5(A) is a plan view of the movable piece and FIG. 5 (B) is a front view of the same.
Figure 5B:
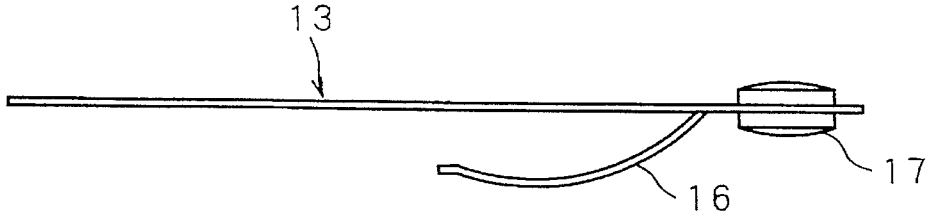

The common terminal 6 is formed with an anchor portion 11 and a spring retaining portion 12, for securely holding in place on terminal 6 the movable switch piece 13 (FIG. 1). Movable piece 13 is an element that can be punched out from metallic spring material, as shown in FIGS. 5(A) and 5(B). The movable piece 13 is formed with an engaging portion 14 at its rear end, an actuator contacting portion 15 at its center and a spring portion 16 close to and extending beneath its front end. A movable contact 17 is fixed to the front end of movable piece 13.

When the movable piece 13 is set in position on the terminal 6, the engaging portion 14 of the movable piece 13 engages the anchor member 11. The front end of the spring portion 16 engages the spring retaining portion 12. The movable contact 17 is situated between the two stationary contacts 9, 10 in such a manner that, in the neutral state, the movable contact 17 contacts the first stationary contact 10.

Figure 2:
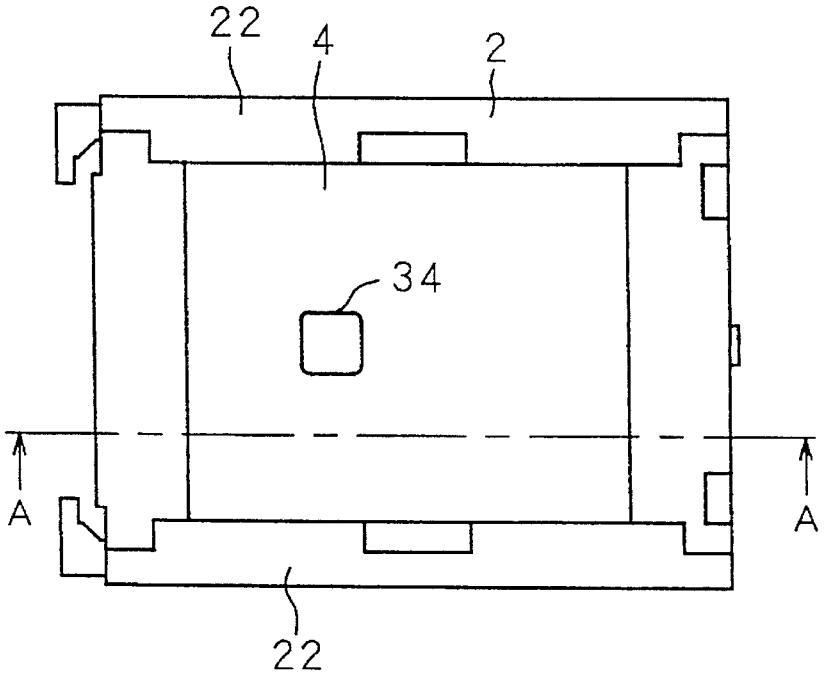
FIG. 2 is a plan view of the switch.
Figure 3:
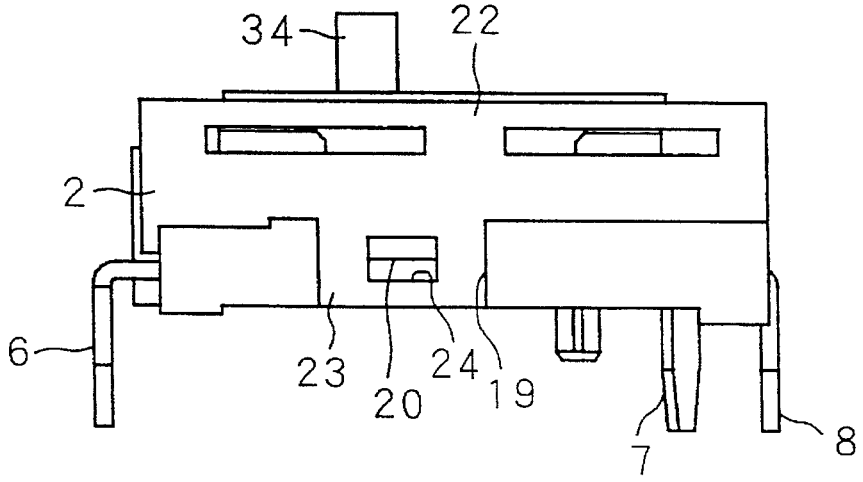
FIG. 3 is a front view of the switch.

Referring to FIGS. 1–3, the front, rear and sides of the base 1 are respectively formed with engaging portions 18, each of which has an engaging channel 19 and an engaging projection 20 extending from these engaging channels 19.

The cover 2 has a surface 2*a*, which is formed with a pair of actuator slots 21 and further with guide rails 22 rising along each of its sides. The cover 2 is further formed with engaging legs 23 at its rear and sides. Each engaging leg 23 has an engaging slot 24.

The switch is assembled by affixing the cover 2 to the base 1. The projections 20 mate with the corresponding engaging slots 24 in cover 2.

Referring again to FIGS. 1, 2 and 3, the slider 4 is placed in sliding relation with the cover 2 by the engagement of guides 33 with guide rails 22. Handle 34 facilitates the backward and forward movement of slider 4 along the top of the cover. Slot 21 provides an opening in the cover for the insertion of replacement fusible actuators 25.

Figure 6A:
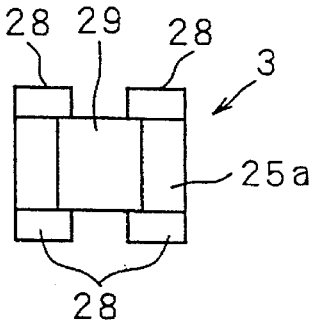
FIG. 6(A) is a plan view of the actuator.
Figure 6B:
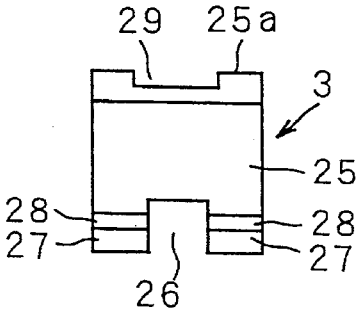
FIG. 6(B) is a side view of the same and FIG. 6(C) is a front view of the same.
Figure 6C:
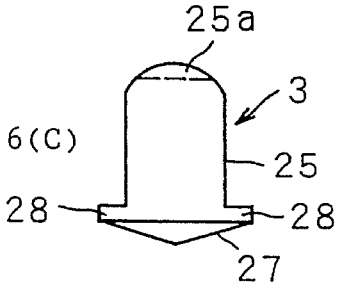

The actuator 3 is shown in FIGS. 6(A), (B) and (C). The actuator 3 includes a body 25, formed with a groove 26 extending throughout its length in the center of its bottom side, and a pair of presser parts 27 on both sides of groove 26. The actuator body has stoppers 28 on both sides of each presser part 27, while the end of the presser part 27 is configured in the form of a hill (conically). An apical part 25*a* of body 25 is configured to present an arcuate form in transverse elevation, and is centrally formed with a groove 29 extending along its length.

The slider 4 is configured in the form of a slab or plate, as shown in FIG. 4. Its bottom is formed with an actuator ON surface portion 35, an actuator OFF surface portion 30 and a stopper portion 31. A transition portion 32 between the actuator ON surface portion 35 and actuator OFF surface portion 30 is smoothly inclined.

When the switch is assembled, the pressers 27 of the actuator 3 contact the actuator contacting portion 15 of the movable piece 13. The body 25 of the actuator 3 thereby projects upwardly beyond the upper surface of the cover 2. Then, the guides 33 of the slider 4 are engaged with the guide rails 22 of the cover 2.

In this arrangement, the slider 4 is free to move in the transverse direction, and apex 25*a* of the actuator body is in slidable contact with the actuator OFF surface portion 30 of the slider 4.

Figure 10:
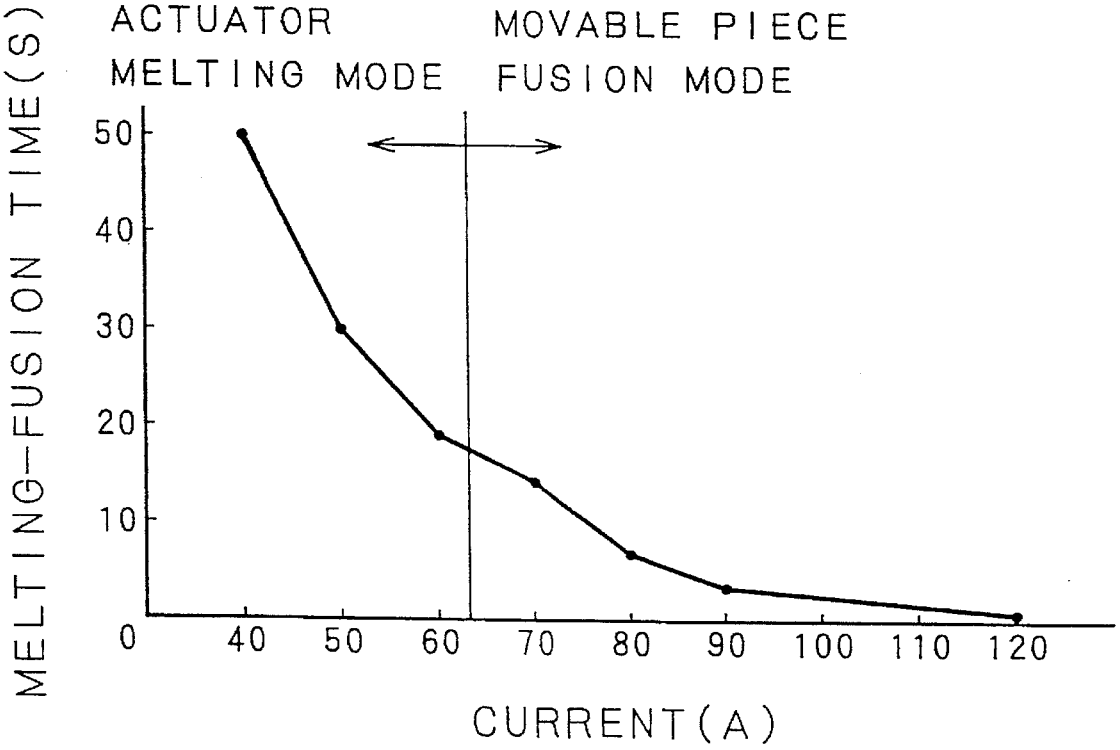
FIG. 10 is a diagram showing the relationship between current values and melt/fusion times of the actuator/movable piece.

The actuator 3 is made, in one embodiment, of PBT—30% glass bead. Its thermal deformation temperature is 190° C. The actuator melt mode in this case is shown in FIG. 10. Thus, in the current range of 40A–64A, the melting time, is correspondingly, 50 sec–18 sec and the melting temperature is about 200° C.–240° C.

On the other hand, the movable piece 13 may be made of C1720-HM (beryllium-copper alloy), then gold-plated for added conductivity. Its melting temperature is about 865° C. The movable piece melt mode is also shown in FIG. 10.

In the current value range of 65A–120A, the melting time range is not greater than 20 sec. Therefore, the actuator 3 is able to withstand the heat generated in ordinary service, but melts from the flow of an overcurrent short of the fusible temperature of the movable piece.

The action of the switch of the above construction can now be explained. When the slider 4 is situated in the neutral position, as illustrated in FIG. 4, the apex 25*a* of actuator 3 slidably contacts the actuator OFF surface portion 30 of the slider 4. When the slider is in the neutral position, the contact 17 on movable piece 13 of the switching mechanism 5 contacts the second stationary contact 10. Thus, the switch is in the OPEN position.

As the slider 4 is moved to the left as illustrated in FIG. 7, the apex 25*a* of actuator 3 slidably contacts the actuator ON surface 35 of the slider 4, whereupon the actuator 3 is displaced into contact with portion 15 of the movable piece 13. In this state, contact 17 of the movable piece 13 contacts the first stationary contact 9. Thus, the switch is brought into the ON state, (i.e., the closed position).

As mentioned above, the actuator 3 may be made of PBT—30% glass beads. While actuator 3 withstands ordinary heat, it melts from an overcurrent short of fusion of the movable piece 13.

Figure 8:
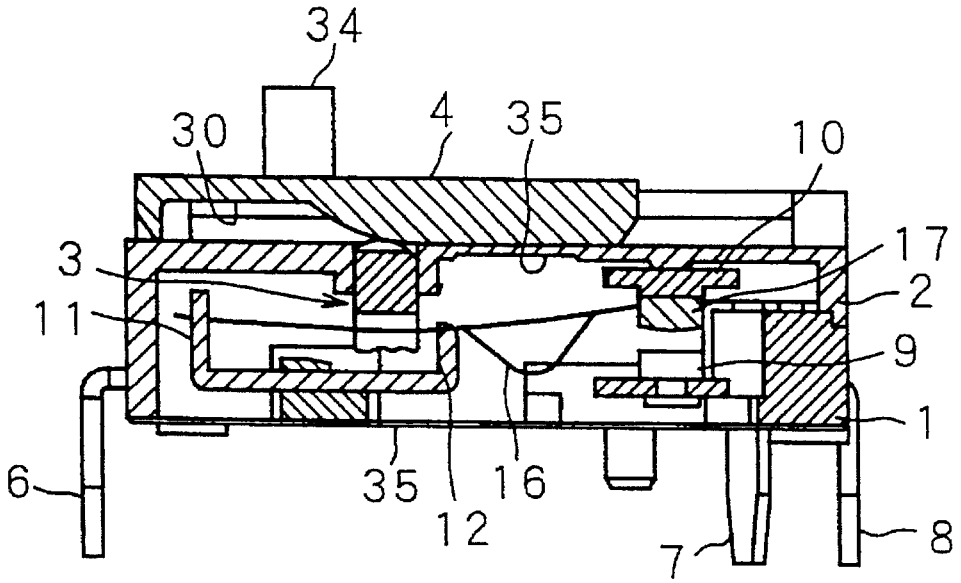
FIG. 8 is a cross-sectional view showing the melting of the actuator by an overcurrent in the switch.

Therefore, when an overcurrent is short of the melting of movable piece 13, the actuator 3 melts and loses its restraining effect on the movable piece 13. Therefore, as shown in FIG. 8, the movable piece 13 is reset by the biasing force of the spring member 16. The movable contact 17, urged away from the first stationary contact 9, contacts the second stationary contact 10. Thus the switch is caused to open.

As mentioned above, the bottom of body 25 of actuator 3 is centrally formed with a longitudinal groove 26 extending over its length. The portions of the body 25 on both sides of this groove serve as presser parts 27 contacting the movable piece 13. Therefore, the melt volume of the actuator is decreased. The increased pressure from the movable piece 13 per unit area thereby accelerates the melting of the actuator 3. Moreover, the actuator 3 is light in weight.

The movable piece 13, common terminal 6 and stationary terminal 7 may be gold-plated, as earlier mentioned. By selecting the thickness of the gold plating layer, so that the generation of heat in the movable piece 13 will increase with a current overload, the melting of actuator 3 can be hastened.

In the above embodiment, before smoking or ignition takes place, the actuator 3 melts and the movable piece 13, free from the restraint of actuator 3, returns to its initial OPEN position. The actuator 3 can be replaced, after an overcurrent, without replacing the basic components of the microswitch.

Figure 9:
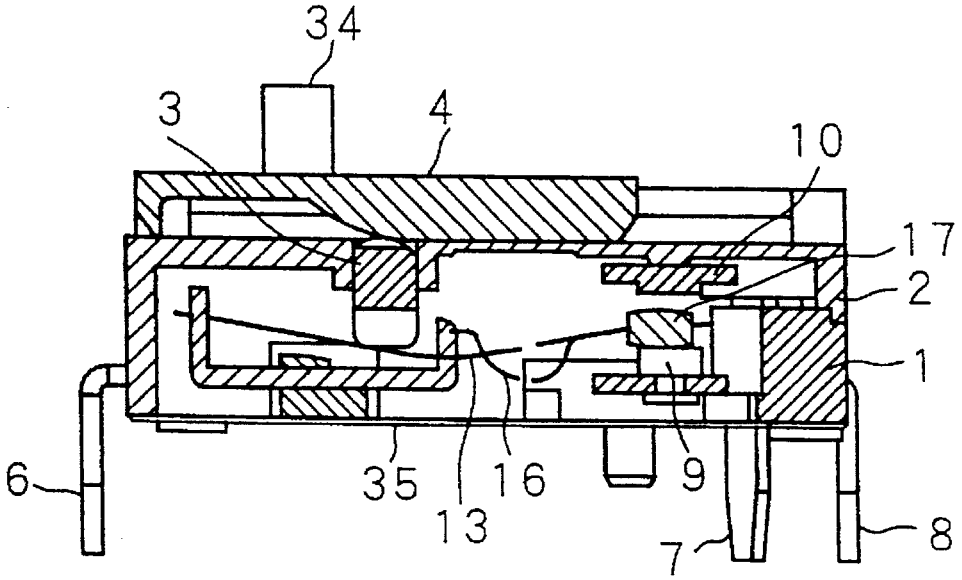
FIG. 9 is a cross-sectional view showing fusion of the movable piece upon the flow of an overcurrent in the switch.

The safety feature shown in FIG. 9 constitutes another embodiment of the invention. In this embodiment, the movable piece 13, rather than the actuator, is first melted from the heat generated by an overcurrent. The actuator 3 is ordinarily made of a thermoplastic material reinforced with glass beads, which melts from a flow of an overcurrent short of fusion of the movable piece, as explained above.

Even when the actuator 3 melts from the flow of an overcurrent, however, there is a certain lag time in the reversal of the movable piece 13 due to its movement or welding between contacts 9 and 17. In the event there is no suitably prompt switch-off, the movable piece 13 will melt to cause an OFF fault. When the movable piece 13 is designed to melt from an overcurrent short of the amount needed for melting of actuator 3, so as to be the first melted, it should melt first. If the melting of the movable piece 13 is delayed, however, the actuator 3 melts so that movable piece 13 can promptly switch off. Thus, even more effective double overcurrent protection can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrical switch comprising:

a movable piece biased to render the switch open;

a meltable actuator for holding the movable piece in a position that renders the switch closed, the actuator being made of a material that melts from an overcurrent therethrough, wherein melting of the actuator by such an overcurrent releases the movable piece to return to its switch open position and open the switch; and a mechanical assembly to allow the actuator to move away from the movable piece to place the switch in an OFF state when the actuator is not melted.

2. The electrical switch of claim 1, wherein the movable piece is made of a material that melts at a predetermined temperature caused by an overcurrent therethrough, the melting of the movable piece enabling the movable piece to return to its switch OPEN state, thereby preventing the switch from conducting.

3. The electrical switch of claim 1, wherein the actuator is a thermoplastic material.

4. The electrical switch of claim 3, wherein the actuator is a polybutyrene terephthalate (PBT)—30% glass bead compound.

5. The electrical switch of claim 2, wherein the movable piece is gold-plated to increase its electrical conductivity.

6. The electrical switch of claim 1, wherein one end of the movable piece is immovably affixed to the switch and its other end carries a contact, the contact assuming one position to render the switch conductive and a second position to render the switch non-conductive.

7. The electrical switch of claim 1, further including an opening in the switch through which a melted actuator may be replaced without opening the switch.

8. The electrical switch of claim 1, wherein the movable piece is made of a material that melts from an overcurrent to allow return of the movable piece to the switch OPEN position in the event that the actuator does not melt quickly enough to safeguard a device in which the switch is installed.

9. The electrical switch of claim 1, wherein the movable piece is made of a material that melts from an overcurrent therethrough, such material having a lower melting temperature than the material of the actuator.

10. An electrical switch comprising:

a movable piece biased to render the switch open;

a meltable actuator holding the movable piece in a position that renders the switch closed, the actuator being made of a material that melts from an overcurrent therethrough, wherein melting of the actuator by such an overcurrent releases the movable piece to return to its switch open position and open the switch; and a sliding member contacting an end of the actuator, the sliding member having two surfaces, one surface allowing the actuator to move away from the movable piece and place the switch in an OFF state, the other surface causing the actuator to contact the movable piece and place the switch in an ON state.

* * * * *